US006736297B2

(12) United States Patent
Kassian et al.

(10) Patent No.: US 6,736,297 B2
(45) Date of Patent: May 18, 2004

(54) BELT TRAP DOOR CLOSURE

(75) Inventors: James E. Kassian, Columbus, NE (US); Richard D. Jedlicka, Lincoln, NE (US); Justin M. Bell, Rising City, NE (US)

(73) Assignee: Timpte Inc., David City, NE (US)

( * ) Notice: Subject to any disclaimer, the term of this patent is extended or adjusted under 35 U.S.C. 154(b) by 84 days.

(21) Appl. No.: 10/085,365

(22) Filed: Feb. 28, 2002

(65) Prior Publication Data

US 2002/0121532 A1 Sep. 5, 2002

Related U.S. Application Data

(60) Provisional application No. 60/273,085, filed on Mar. 2, 2001.

(51) Int. Cl.[7] ..... B67D 47/00
(52) U.S. Cl. ..... 222/561
(58) Field of Search ..... 222/561, 559

(56) References Cited

U.S. PATENT DOCUMENTS

| | | | | |
|---|---|---|---|---|
| 2,515,137 A | | 7/1950 | Schall et al. | |
| 2,544,117 A | | 3/1951 | Weatherly | |
| 2,690,352 A | | 9/1954 | Turner | |
| 2,859,888 A | | 11/1958 | Fairnington | |
| 2,901,281 A | | 8/1959 | Martins | |
| 2,969,083 A | | 1/1961 | Joyce | |
| 3,100,457 A | | 8/1963 | Dorey | |
| 3,241,730 A | | 3/1966 | Dorey | |
| 3,262,610 A | | 7/1966 | Jordan | |
| 3,433,178 A | | 3/1969 | Floehr | |
| 3,826,203 A | | 7/1974 | Martin et al. | |
| 3,958,515 A | | 5/1976 | Goudy | |
| 3,997,089 A | | 12/1976 | Clarke et al. | |
| 4,030,639 A | | 6/1977 | Parish et al. | |
| 4,055,265 A | | 10/1977 | Eisenman | |
| 4,193,159 A | | 3/1980 | Beard, III | |
| 4,359,176 A | | 11/1982 | Johnson | |
| 4,475,672 A | * | 10/1984 | Whitehead | 222/561 |
| 4,573,614 A | | 3/1986 | Ozawa | |
| 4,589,579 A | | 5/1986 | Morita | |
| 4,785,966 A | | 11/1988 | Waltke | |
| 5,038,966 A | | 8/1991 | Olk | |
| 5,211,030 A | | 5/1993 | Jameson | |
| 5,263,422 A | | 11/1993 | Barefoot | |
| 6,085,948 A | | 7/2000 | Putze | |

FOREIGN PATENT DOCUMENTS

SU 1632876 A1 3/1991

* cited by examiner

*Primary Examiner*—Philippe Derakshani
(74) *Attorney, Agent, or Firm*—Michael Best & Friedrich LLP

(57) ABSTRACT

A closure device for sealing an aperture of a storage container includes a trap frame, and a trap door connected to the trap frame for movement with respect to the trap frame. The trap door is movable between an open condition and a closed condition, and the trap door in the closed condition seals the aperture. The trap door includes a traversing frame having two side supports and multiple inner rollers extending between the side supports. A belt surrounds the traversing frame, and revolves around the traversing frame as the trap door moves between the open and closed condition. The belt is connected to the trap frame such that at least a portion of the belt remains stationary in relation to the trap frame while the traversing frame moves, and at least a portion of the belt moves in relation to the trap frame while the traversing frame moves.

36 Claims, 8 Drawing Sheets

BELT TRAP DOOR CLOSURE

This Patent Application claims the benefit of the earlier filing date of provisional patent application No. 60/273,085 filed Mar. 2, 2001.

FIELD OF INVENTION

The present invention relates to storage containers, and more particularly to closure devices for storage containers, such as a door, gate or chute.

BACKGROUND OF INVENTION

Bulk commodity hoppers are storage containers commonly used to store a wide variety of products, such as grain, produce, fertilizer, and rock. Hoppers may be incorporated into trailers, vessels, railroad cars, and other vehicles to transport a bulk commodity, or may be part of a stationary storage structure. Hoppers generally use gravity to discharge the bulk commodity stored within the hopper, and include sloping panels that direct the bulk commodity to a common lower discharge outlet near the bottom of the hopper. In some prior art arrangements, a rigid sliding trap door is used to open, close, or seal the lower discharge outlet. Because the trap door is located under the bulk commodity, the gravitational force from the bulk commodity applies a relatively large downward force upon the trap door. The trap door is generally a horizontally moving door, and the downward force from the commodity on the door creates a friction force against the trap door while the door is being opened.

Prior art trap doors are typically rigid structures with flat upper surfaces, and slide along rails or guides while being opened or closed. As the trap door slides open, the friction from the bulk commodity resists the opening movement and hinders sliding the trap door out from underneath the bulk commodity. Due to the friction force caused by the bulk commodity, a relatively large force may be required to open the trap door. In some prior art trap door opening systems, a gear reduction mechanism provides a mechanical advantage and enables a person to overcome the frictional forces and open the trap door more easily. However, gear reduction mechanisms are often heavy, cumbersome, and can result in slower opening speeds and/or loss of control of the door.

Trap doors of bulk commodity hoppers are usually operated manually with a crank assembly, and the operator must overcome the friction force to open the door. Therefore, any reduction of the friction force also tends to reduce the effort a person must exert to open the door. One known method to reduce the friction force is to have a wedge-shaped door with a slightly inclined top surface so that one end of the door is slightly higher than the other end. An example of a trap door utilizing such an inclined top surface is disclosed in U.S. Pat. No. 6,085,948 issued to Putze. This slanted design slightly shifts the normal force on the door to provide a horizontally acting force component, but the rigid trap door still experiences friction from sliding across the bulk commodity. The force needed to open the slanted trap door may be reduced with this method, but the required force is still relatively large and may be difficult for an average person to operate.

SUMMARY OF THE INVENTION

The invention provides a closure device that greatly reduces the force required to open the closure device. The closure device utilizes a belt or flexible membrane for the trap door. The belt rolls or "peels" away from under the bulk commodity, instead of sliding across it. Since the belt does not slide against the bulk commodity, the friction force between the bulk commodity and the belt is substantially eliminated.

More particularly, the invention has a trap frame that surrounds and defines an aperture near the bottom of the hopper. The trap frame supports a trap door that moves with respect to the trap frame between an open condition and a closed condition. When the trap door is in the open condition, the aperture is open and the bulk commodity may pass through the aperture. When the trap door is in the closed condition, the aperture is closed and substantially sealed, and the bulk commodity may be retained within the hopper.

The trap door includes a traversing frame and a belt. The traversing frame has two side supports that are spaced apart, and have longitudinal axes that are substantially parallel to each other. The traversing frame has multiple inner rollers extending between the side supports. The multiple rollers may rotate with respect to the side supports. The traversing frame extends substantially horizontally and moves substantially horizontally from a position beneath the opening to a position away from the opening.

The belt is a flexible member, similar to a conveyor belt, that at least partially surrounds the traversing frame. The belt seals the aperture when the trap door is closed, so the belt must remain in tension to retain the bulk commodity. Both ends of the belt are preferably stationary and are joined to the trap frame to maintain tension in the belt. The belt moves around the traversing frame as the trap door moves between the open and closed conditions.

More accurately, perhaps, the traversing frame moves horizontally within the interior of the belt. As the traversing frame moves from the closed condition to the open condition, the upper run of the belt travels around the end roller of the traversing frame to the bottom of the traversing frame, at the same time "peeling" away from the upper opening and the material in the hopper. During this movement, the lower run of the belt moves around the opposite end roller of the traversing frame, becoming the upper run in a position offset from the opening. This arrangement is similar to a conveyor belt with the frame moving inside the belt instead of being stationary.

Figure 1:
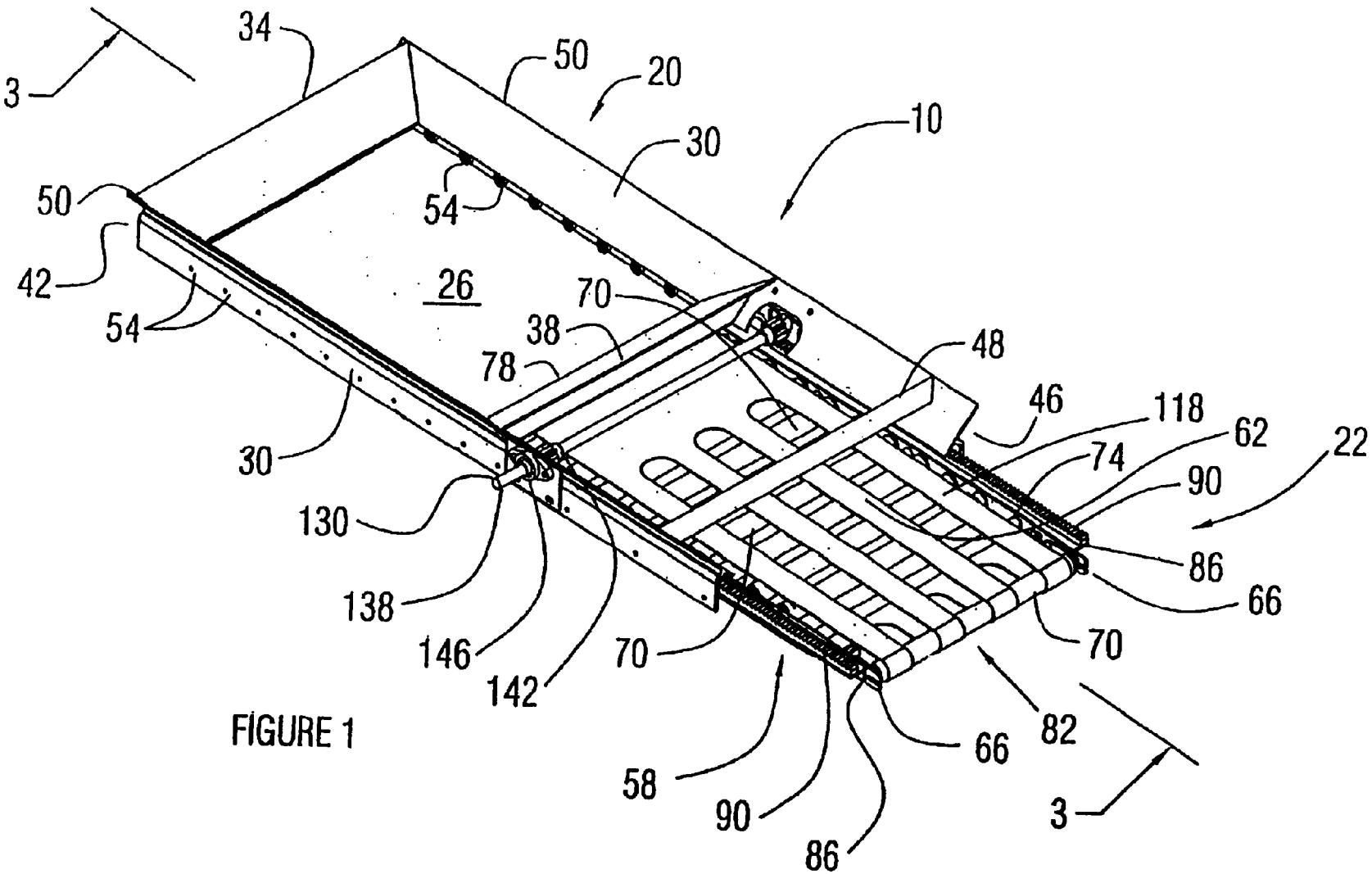
FIG. 1 is a perspective view of a closure device embodying the present invention in the open position.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

Although references are made below to directions, such as left, right, up, down, upper, lower, top, bottom, front, rear, back, clockwise, counter-clockwise, etc., in describing the drawings, they are made relative to the drawings (as normally viewed) for convenience. These directions are not intended to be taken literally or limit the present invention in any form.

DETAILED DESCRIPTION

Figure 2:
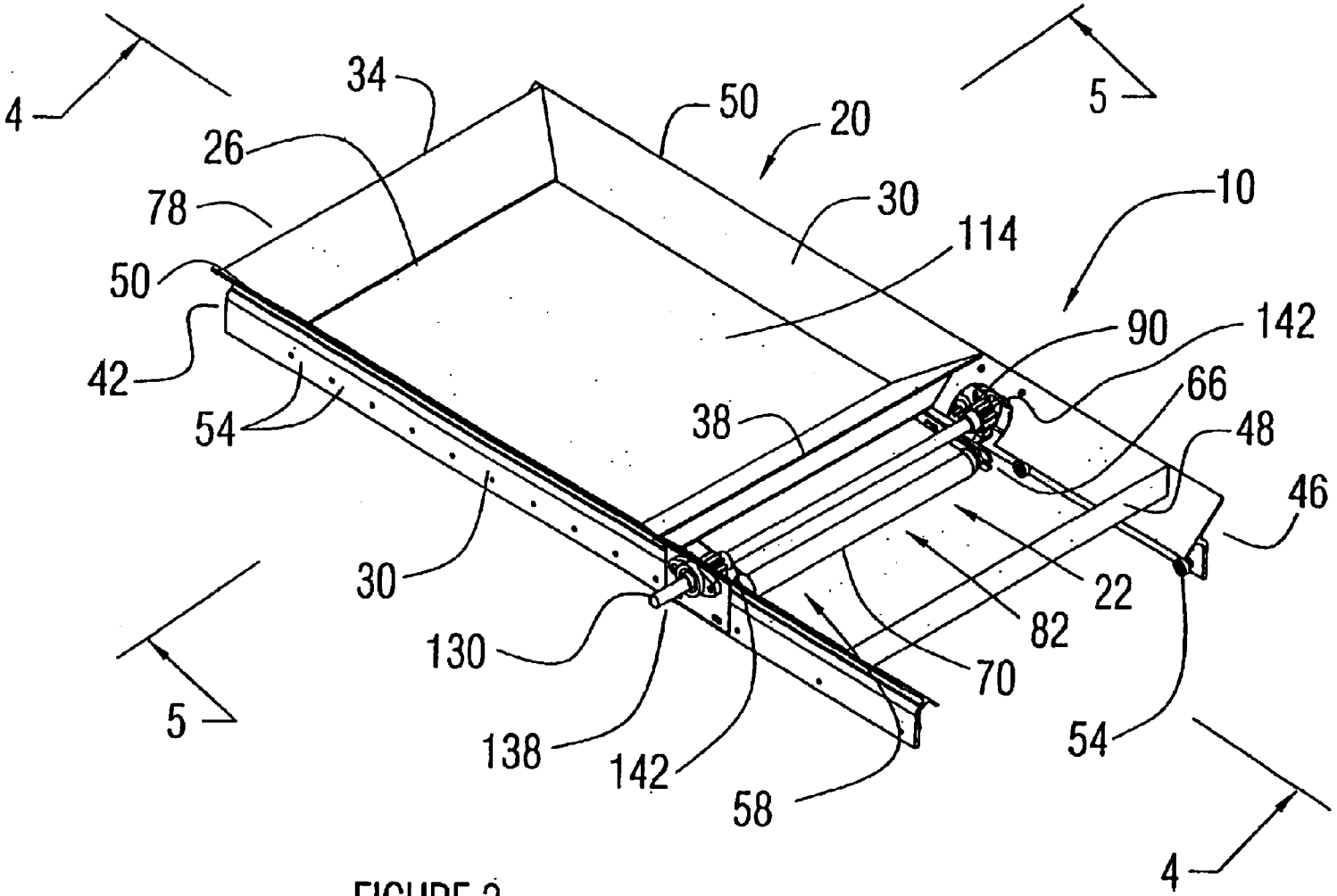
FIG. 2 is a perspective view of the closure device of FIG. 1 in the closed position.
Figure 3:
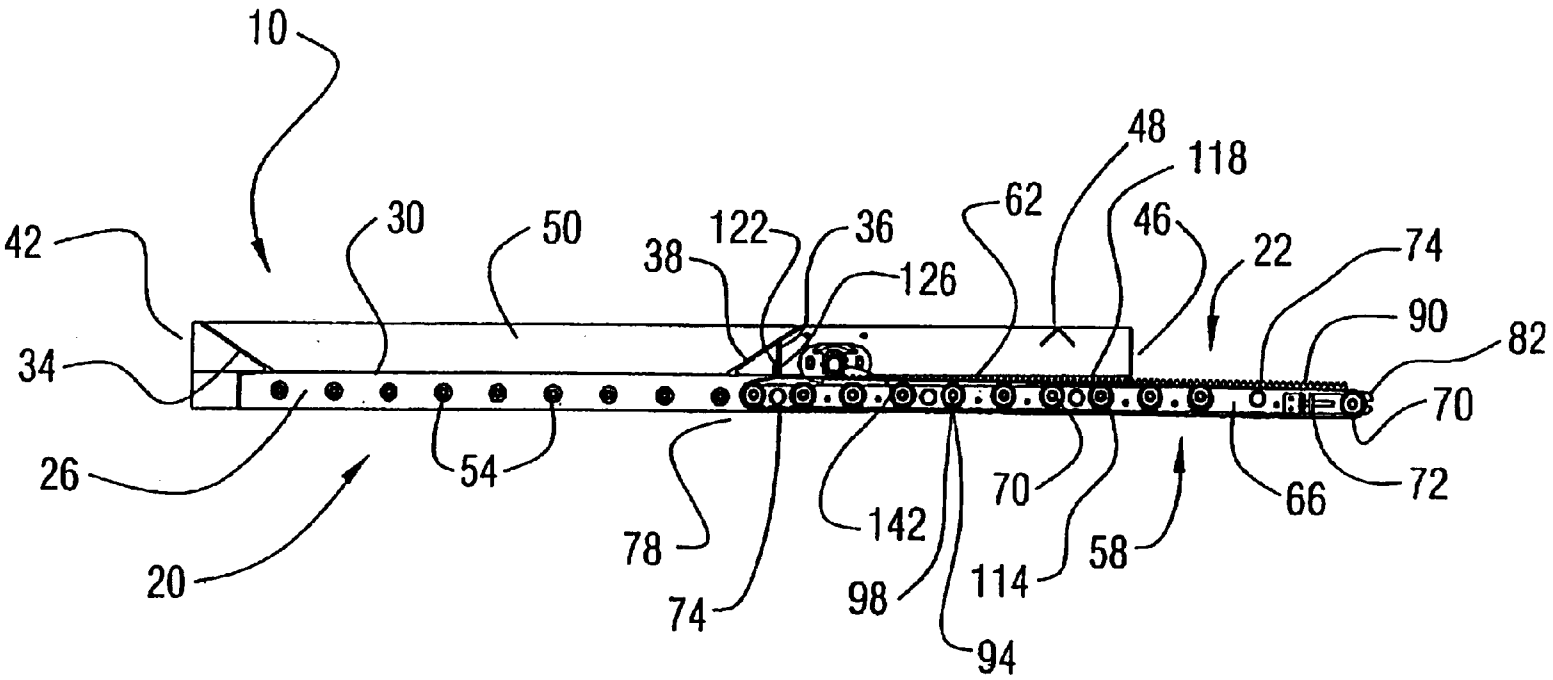
FIG. 3 is a cross-sectional view, taken along line 3—3 of FIG. 1.
Figure 4:
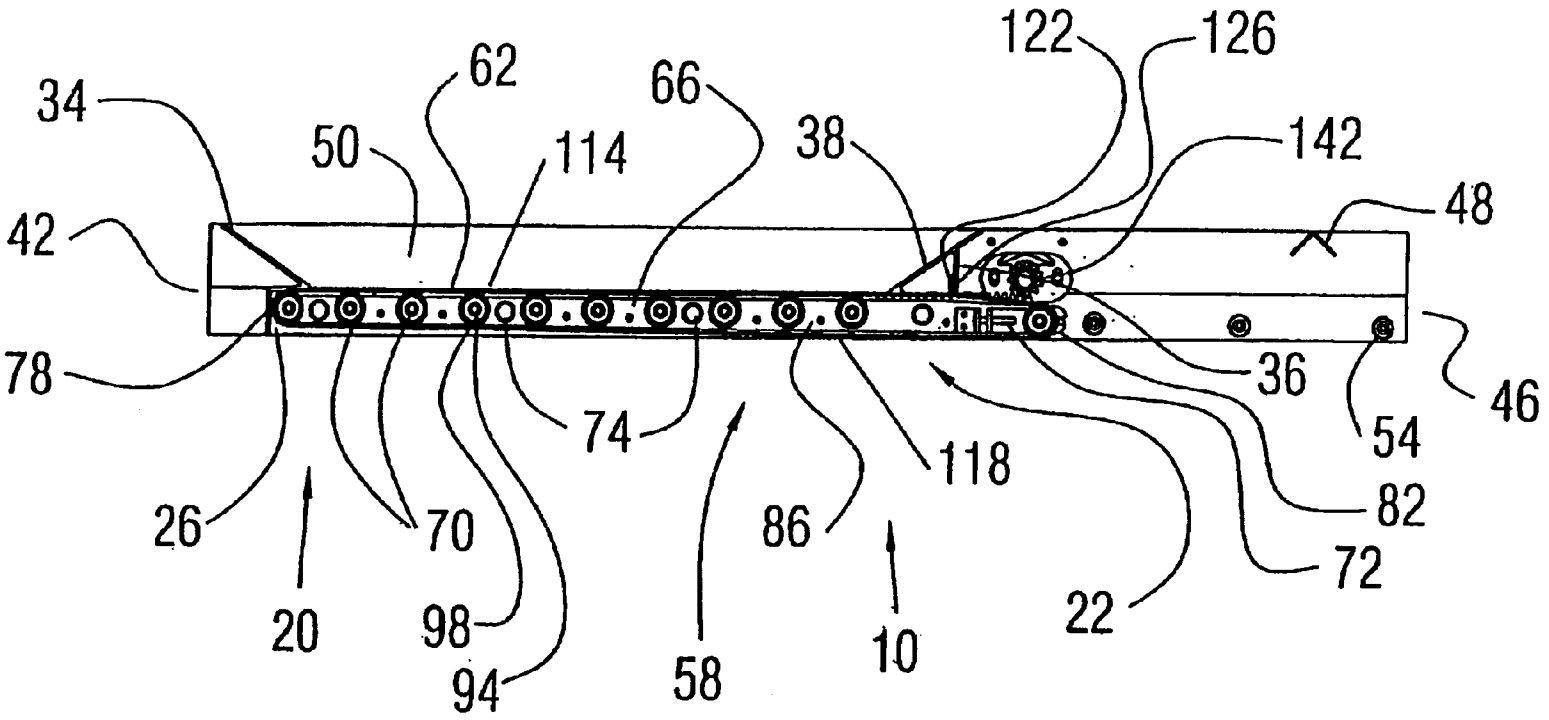
FIG. 4 is a cross-sectional view, taken along line 4—4 of FIG. 2.

The embodiment of the invention illustrated in FIG. 1 is a closure device 10 for a storage container or hopper used for the storage or transportation of a bulk commodity. The closure device 10 comprises a trap frame 20 and a trap door 22. The trap door 22 is movable with respect to the trap frame 20 between an open condition and a closed condition. FIGS. 1 and 3 illustrate the open condition, and FIGS. 2 and 4 illustrate the closed condition. When the trap door 22 is in the open condition as shown in FIG. 1, an aperture 26 near the bottom of the hopper is open and exposed. The aperture 26 is a discharge outlet through which the bulk commodity passes when the hopper is emptied. The closure device 10 reseals the aperture 26 when the trap door 22 is moved to the closed condition, as shown in FIG. 2.

The present invention may be used with almost any hopper or storage container, and may be incorporated into a trailer, railroad car, vessel, vehicle, structure, or other similar movable or stationary storage apparatus. As illustrated in FIG. 1, the trap frame 20 surrounds and defines the discharge aperture 26 near the bottom of the hopper. The trap frame 20 is rigid, substantially horizontal, and substantially rectangular. The trap frame 20 is comprised of several elongated metal plates, including two substantially similar side members 30, a first member 34, and an intermediate member 38. The side members 30 are spaced apart and have longitudinal axes that are substantially parallel to each other. The first member 34 and the intermediate member 38 extend between the two side members 30 and stabilize the trap frame 20.

As viewed in FIGS. 1–4, the trap frame 20 has a first portion 42 near the left side of the figures, and a second portion 46 near the right side of the figures. As shown in FIG. 1, the first member 34 is coupled to the two side members 30 near the first portion 42 of the trap frame 20, and the intermediate member 38 is coupled to the two side members 30 between the first portion 42 and the second portion 46 of the trap frame 20. The side members 30 extend beyond the intermediate member 38 toward the second portion 46 of the trap frame 20 to provide support for the trap door 22 in the open condition. In the illustrated embodiment, a brace 48 extends between the side members 30 near the second portion 46 to provide stabilization for the trap frame 20.

In FIG. 1, each side member 30 has an upper leg 50 along the upper edge of the side member 30. The upper leg 50 is a sloped portion that slopes downwardly and inwardly, and directs the bulk commodity toward the aperture 26 when the hopper is discharged. The first member 34 and intermediate member 38 also have sloped portions that direct the bulk commodity toward the aperture 26 when the hopper is discharged.

Each side member 30 also has multiple outer rollers 54 spaced linearly along the length of the side member 30. In the illustrated embodiment, the outer rollers 54 are cantilevered bearing rollers coupled to the side members 30. The outer rollers 54 are aligned linearly along the interior surface of the side members 30 facing the aperture 26, and extend inwardly toward the aperture 26. The outer rollers 54 support the trap door 22 which rolls along the outer rollers 54 while opening and closing. The axes of rotation of the outer rollers 54 define a generally horizontal plane, but the plane may be slightly slanted as described below.

The trap frame 20 supports the trap door 22 for movement relative to the trap frame 20 between an open condition and closed condition to open and close the aperture 26. FIGS. 1 and 3 illustrate the trap door 22 in the open condition with the aperture 26 open, permitting the bulk commodity to discharge through the aperture 26. FIGS. 2 and 4 illustrate the trap door 22 in the closed condition with the aperture 26 closed. When the trap door 22 is in the closed condition, the trap door 22 retains the bulk commodity within the hopper. The trap door 22 sufficiently seals the aperture 26 to substantially prevent the bulk commodity from passing through the aperture 26.

The trap door 22 includes a traversing frame 58 and a belt 62. As shown in FIG. 1, the traversing frame 58 is rectangular and has two side supports 66, multiple inner rollers 70, and multiple lateral tubes 74. The side supports 66 extend approximately the length of the traversing frame 58 from a lead end 78 to a take-up end 82, and are substantially parallel to the axes of the outer rollers 54. Track rails 86 and gear racks 90 are interconnected to the side supports 66, and also extend along the length of the traversing frame 58. As viewed in FIGS. 1–4, the lead end 78 is on the left side of the traversing frame 58, and the take-up end 82 is on the right side of the traversing frame 58.

The lateral tubes 74 and inner rollers 70 are interconnected between the side supports 66 at spaced intervals, and are substantially transverse to the side supports 66. As shown in FIG. 3, the inner rollers 70 are preferably full-length bearinged rollers that include bearings which are press-fit on an inner journal 94, and are surrounded by a cylindrical outer portion 98. The outer portion 98 may rotate freely around the inner journal 94, while the inner journal 94 remains fixed with respect to the traversing frame 58.

The lateral tubes 74 are rigid elongated members that remain fixed with respect to the traversing frame 58. In the illustrated embodiment, the inner rollers 70 and the lateral tubes 74 have circular cross-sections, and the diameter of the lateral tubes 74 is less than the diameter of the inner rollers 70. The smaller diameter of the lateral tubes 74 reduces the resistance, or friction, between the belt 62 and the traversing frame 58 while the trap door 22 is opening. The top edges of the lateral tubes 74 are below the top edges of the inner rollers 70, so there is relatively little contact between the belt 62 and lateral tubes 74.

Inner rollers 70 are located at both the lead end 78 and the take-up end 82 of the traversing frame 58, and additional inner rollers 70 and lateral tubes 74 are located at spaced intervals along the side supports 66 between the lead end 78 and the take-up end 82. In the illustrated embodiment, there are eleven inner rollers 70 and four lateral tubes 74 along the length of the traversing frame 58, but the quantities of each may change with different configurations.

Figure 7:
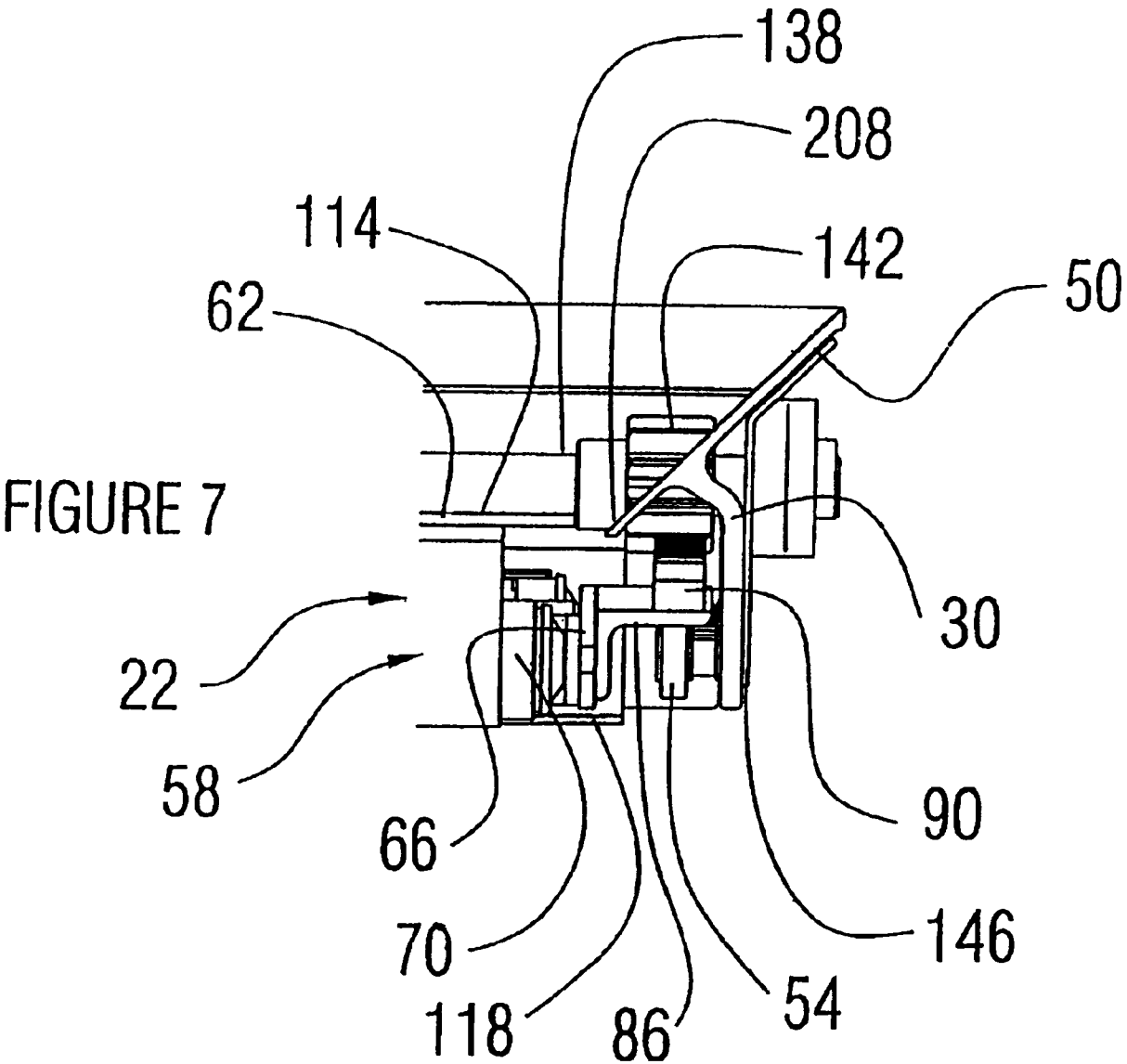
FIG. 7 is an enlarged view of a portion of FIG. 5.

As shown in FIG. 7, the track rails 86 are elongated beams with an L-shaped cross-section. The open portion of the track rail 86 faces down and away from the traversing frame 58 and toward the side member 30. The outer rollers 54 extend under the track rail 86 and support the traversing frame 58. The track rails 86 ride along the outer rollers 54 and allow the traversing frame 58 to move smoothly between the open condition and the closed condition. The outer rollers 54 support the track rails 86, and bear most of the force exerted upon the trap door 22 by the bulk commodity while the trap door 22 is closed. The gear racks 90 have multiple teeth that mesh with spur gears (described below) to facilitate opening and closing the trap door 22, as described below. The gear racks 90 are mounted along the top of the track rails 86, such that the teeth face upward.

As shown in FIG. 4, the belt 62 is a flexible membrane that extends around the traversing frame 58, and substantially seals the aperture 26 when the trap door 22 is closed. The belt 62 and traversing frame 58 assembly has an arrangement similar to that of a conveyor belt, and operates as if the conveyor belt frame is rolled out or peeled away from under an object while the object remains stationary. As the trap door 22 opens, the traversing frame 58 and at least a first portion of the belt 62 move in relation to the trap frame 20 and the bulk commodity, while at least a second portion of the belt 62 remains stationary in relation to the trap frame 20 and the bulk commodity. In other words, when the trap door 22 is opened, the bulk commodity is held in place while the trap door 22 is progressively rolled out from underneath the bulk commodity with minimal resistance from friction force. The belt 62 bends around the inner rollers 70 at the ends 78, 82 of the traversing frame 58 when the trap door 22 is opened or closed.

The belt 62 preferably has two segments: a contact segment 114 and a link segment 118. The belt 62 also has two ends: a contact end 122 adjacent the contact segment 114, and a link end 126 adjacent the link segment 118. In the illustrated embodiment, the two ends 122, 126 of the belt 62 are joined to the intermediate member 38 by way of an adjoining member 36. Alternatively, the belt 62 may also be a continuous belt that completely surrounds the traversing frame 58 and is not joined to the trap frame 20.

The contact segment 114 is the portion of the belt 62 that contacts and retains the bulk commodity in the hopper while the trap door 22 is closed. When the trap door 22 is closed, the contact segment 114 is the upper run, and the link segment 118 is the lower run. As the trap door 22 opens, the contact segment 114 wraps around the lead end 78 to the lower run, and the link segment 118 wraps around the take-up end 82 to the upper run.

The contact segment 114 defines the sealing portion of the trap door 22 while the trap door 22 is closed. In the preferred embodiment, the belt 62 is made of a rubberized canvas, woven plied canvas belting, or a similar, durable material. The contact segment 114 must be of sufficient strength and solidity to seal the aperture and retain the bulk commodity stored within the hopper. A contact end 122 is the end of the belt 62 adjacent the contact segment 114, and is preferably joined to the intermediate member 38 by the adjoining member 36. As shown in FIG. 4, the contact segment 114 is disposed above the traversing frame 58 while the trap door 22 is in the closed condition. The contact segment 114 extends around the lead end 78 of the traversing frame 58 and interconnects to the link segment 118.

The link segment 118, as illustrated in FIG. 4, is the portion of the belt 62 disposed along the bottom of the traversing frame 58 while the trap door 22 is in the closed condition. The link segment 118 extends around the take-up end 82 of the traversing frame 58, and the link end 126 is joined to the intermediate member 38 by the adjoining member 36. As viewed in FIGS. 3 and 4, the belt 62 revolves counter-clockwise around the traversing frame 58 as the trap door 22 moves from the closed condition (FIG. 4) to the open condition (FIG. 3). Therefore, as shown in FIG. 3, when the trap door 22 is in the open condition, the contact segment 114 is disposed below the traversing frame 58, and the link segment 118 is disposed above the traversing frame 58.

The belt 62 must remain taut with enough tension to retain the bulk commodity. A tightening device 72 may be used to adjust the inner roller 70 at the take-up end 82 to tighten the belt 62 and eliminate any extra slack. The tightening device 72 may increase or decrease the tension in the belt 62. The contact segment 114 is substantially solid to retain the bulk commodity, and the link segment 118 reconnects the contact segment 114 back to the intermediate member 38 to maintain sufficient tension in the belt 62. The link segment 118 must remain in tension, but it does not have to be solid. The link segment 118 may be made from straps or a durable mesh material with multiple openings.

The closure device 10 does not have a perfect seal, and small portions of the bulk commodity may pass through the seal while the trap door 22 is closed. As shown in FIG. 1, the link segment 118 is permeable or perforated and has at least one opening to permit these small portions of the bulk commodity to fall through the openings in the link segment 118 when the trap door 22 is in the closed condition. If the link segment 118 is solid, debris or portions of the bulk commodity could accumulate on the link segment 118, and may interfere with the movement of the trap door 22. Therefore, the link segment 118 has openings to prevent these problems from occurring from accumulating.

Figure 5:
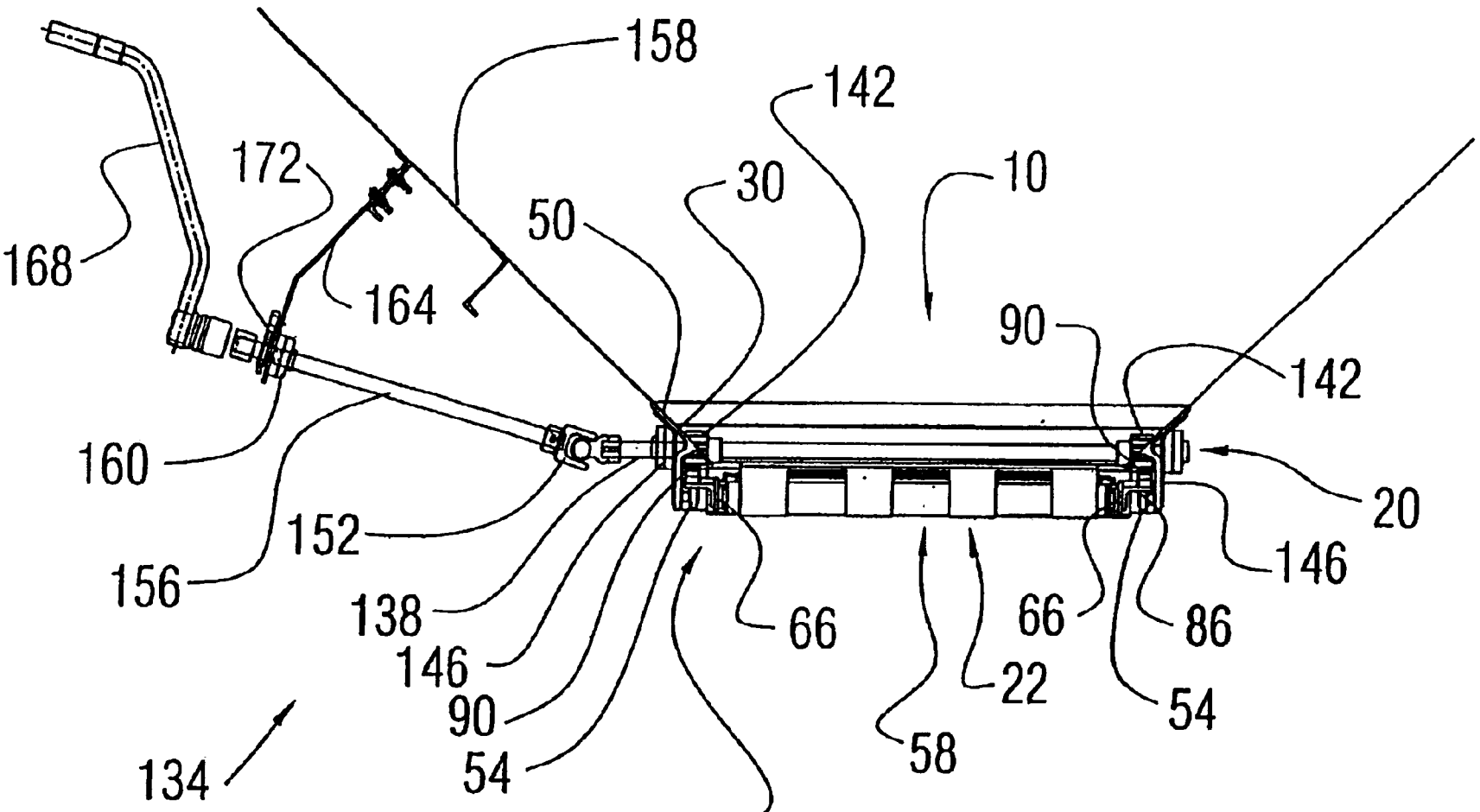
FIG. 5 is a cross-sectional view, taken along line 5—5 of FIG. 2.

As illustrated in FIG. 5, the closure device 10 has a movement system 130 to facilitate moving the trap door 22 between the open condition and the closed condition. The movement system 130 includes a crank assembly 134, a gear shaft 138, spur gears 142, and the gear racks 90. The gear shaft 138 is preferably supported by shaft brackets 146 that are interconnected to the trap frame 20. The spur gears 142 are mounted on the gear shaft 138, and rotate with the gear shaft 138.

The trap door 22 is moved by rotating the crank assembly 134. The gear shaft 138 is connected to the crank assembly 134, and rotation from the crank assembly 134 is transferred through the gear shaft 138 to rotate the spur gears 142. The spur gears 142 intermesh with the gear racks 90 and transfer the rotational motion from the crank assembly 134 into translational motion of the traversing frame 58. As viewed in FIGS. 3 and 4, rotating the spur gear 142 counter-clockwise will move the trap door 22 to the right (toward the open condition) and open the aperture 26. Similarly, rotating the spur gear 142 clockwise will move the trap door 22 to the left (toward the closed condition) and close or seal the aperture 26.

As shown in FIG. 5, the crank assembly 134 preferably has a U-joint 152 that interconnects the gear shaft 138 to a crank shaft 156, and transfers rotation from the crank shaft 156 to the gear shaft 138. The crank shaft 156 extends outward from the trap frame 20 and interconnects with a crank interface 160. FIG. 5 illustrates a portion of the hopper 158 that is the storage container. A crank bracket 164 interconnects the crank interface 160 to the hopper 158, and supports the crank interface 160 and crank assembly 134. The end of the crank shaft 156 near the crank interface 160 has a hex-shaped cross section (FIG. 6) that couples with a mating hex-shaped opening.

In the illustrated embodiment, a removable hand crank 168 having a hex-shaped opening interconnects to the crank interface 160 to rotate the crank assembly 134 and move the trap door 22. The rotation from the hand crank 168 is transferred through the crank shaft 156, U-joint 152, and gear shaft 138, and finally to the spur gears 142. Rotating the hand crank 168 in one direction will open the trap door 22, and rotating the hand crank 168 in the opposite direction will close the trap door 22. The crank shaft 156 is generally rotated manually by having an operator rotate the hand crank 168. Alternatively, the crank assembly 134 could utilize a motorized mechanism to rotate the crank shaft 156 and move the trap door 22 automatically.

Figure 6:
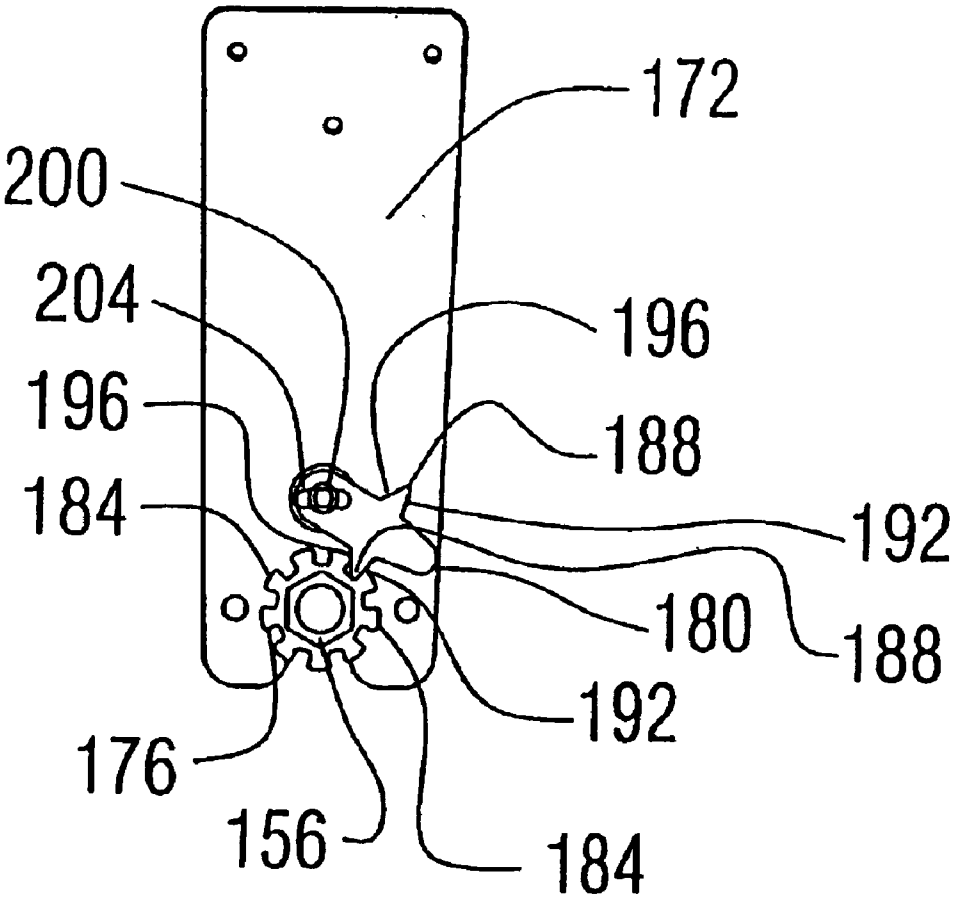
FIG. 6 is an enlarged view of the latching device of the movement mechanism of FIG. 5.

The crank interface 160 has a locking device 172 to prevent the trap door 22 from undesirably reversing direction. As shown in FIG. 6, the locking device 172 is similar to a ratchet. The locking device 172 includes a cog wheel 176 attached to the crank shaft 156, and a pivotable latch 180 that engages the cog wheel 176. When the latch 180 engages the cog wheel 176, the crank shaft 156 is limited to rotation in only one direction. The cog wheel 176 has multiple cog teeth 184 extending outward from the cog wheel 176. The latch 180 has two latch dogs 188 on opposite sides of the latch 180. The latch dogs 188 each have a straight face 192 and an angled face 196, and extend between the cog teeth 184 when the latch 180 engages the cog wheel 176.

As illustrated in FIG. 6, the latch dog 188 is disposed between the cog teeth 184. If the crank shaft 156 rotates clockwise, the cog tooth 184 contacts the angled face 196 of the latch dog 188, and lifts the latch 180 so the crank shaft 156 continues rotating clockwise. However, if the crank shaft 156 rotates counter-clockwise, the cog tooth 184 will contact the straight face 192 of the latch dog 188, and the latch 180 will prevent the crank shaft 156 from rotating any further in the counter-clockwise direction.

The latch 180 is substantially symmetrical, and the locking device 172 may be used to prevent rotation in either direction. A pivot bolt 200 interconnects the latch 180 to the locking device 172, and permits the latch 180 to pivot between an opening condition and a closing condition. FIG. 6 illustrates the latch 180 in the closing condition, only permitting the crank shaft 156 to rotate clockwise. The latch 180 may be pivoted to the opening condition, and only permit the crank shaft 156 to rotate counter-clockwise. The pivot bolt 200 passes through a latch groove 204 in the locking device 172, and the pivot bolt 200 may be fastened to the locking device 172 at various positions along the latch groove 204. The ability to adjust the pivot bolt 200 along the latch groove 204 provides the latch 180 with a greater range of positions with respect to the cog wheel 176, and makes the closure device 10 substantially infinitely adjustable.

When the trap door 22 is in the closed condition, as shown in FIG. 4, the bulk commodity exerts a downward force upon the trap door 22. In conventional trap doors, this downward force creates friction forces that resist the opening of the trap door as the door slides across the bulk commodity. As a result, relatively large forces may be required to overcome the friction force to open the door. The belt 62 and traversing frame 58 substantially reduce the friction forces between the bulk commodity and the trap door 22, and thereby reduce the amount of force required to open the trap door 22.

In the illustrated embodiment of the invention, the trap door 22 does not slide across the bulk commodity; instead the trap door 22 is essentially peeled away from the bulk commodity. The bulk commodity contacts the belt 62 when the trap door 22 is closed. As the trap door 22 moves from the closed condition (FIG. 4) toward the open condition (FIG. 3), the belt 62 revolves around the traversing frame 58 in a counterclockwise direction, so that the link segment 118 moves around the take-up end 82 of the traversing frame 58 from the bottom of the traversing frame 58 to the top. At the same time, the contact segment 114 wraps under the lead end 78 and moves from the top of the traversing frame 58 to the bottom. As the belt 62 revolves around the traversing frame 58, at least a first portion of the belt 62 remains stationary with respect to the trap frame 20, and at least a second portion of the belt 62 moves with respect to the trap frame 20.

The traversing frame 58 supports the belt 62, and the belt 62 retains the bulk commodity when the trap door 22 is closed. When the trap door 22 is opened, the traversing frame 58 is rolled out or peeled away from underneath the bulk commodity, and the bulk commodity passes through the aperture 26. As mentioned above, the inner rollers 70 are free to rotate with respect to the traversing frame 58. The inner rollers 70 significantly reduce the friction between the belt 62 and the traversing frame 58 while the traversing frame 58 rolls under the belt 62 to open the trap door 22. The inner roller 70 and belt 62 configuration of the trap door 22 produces a substantially lower friction force between the bulk commodity and trap door 22 than between the bulk commodity and prior art rigid sliding doors. Therefore, the torque on the crank assembly 134 (FIG. 5) required to open the trap door 22 is also greatly reduced.

As illustrated in FIG. 3, the outer rollers 54 are preferably aligned linearly along the inside surface of the side members 30 in a slightly downward sloping plane from the first portion 42 to the second portion 46 of the trap frame 20. The outer rollers 54 support the track rails 86 of the trap door 22, so the trap door 22 is also aligned along the same plane as the outer rollers 54. Therefore, as the trap door 22 moves from the closed condition (FIG. 4) to the open condition (FIG. 3), the trap door 22 moves slightly downward. This sloped travel path helps relieve the inner rollers 70 of a condition called "commodity compression" while the trap door 22 is opening.

The condition of "commodity compression" occurs because the belt 62 is a flexible membrane, such as rubberized canvas, supported by spaced inner rollers 70. Due to gravity, the bulk commodity exerts a downward force on the belt 62. Since the belt 62 is flexible, the downward force causes the belt 62 to slightly sag between the supporting inner rollers 70, and creates bulges between the inner rollers 70. As the trap door 22 opens, the inner roller 70 must slightly lift and compress these bulges as the traversing frame 58 moves under the belt 62. If the traversing frame 58 travels in a slightly downward sloping plane while opening, each inner roller 70 will have to lift each bulge less than if the travel path was perfectly horizontal. Therefore, the downward sloping travel path reduces the amount each inner roller 70 must lift or compress each bulge in the belt 62, and reduces the resistance for opening the trap door 22.

In FIG. 2, the trap door 22 seals the aperture 26 while in the closed position. As mentioned above, the side members 30 have slanted upper legs 50 to direct the bulk commodity toward the aperture 26. As illustrated in FIG. 7, each upper leg 50 preferably has a closeout seal 208 to provide a better seal. The closeout seals 208 are flexible plastic plates attached to the upper legs 50 along the length of the aperture 26 (FIG. 2), and extend inward beyond the upper legs 50 to contact the belt 62. When the trap door 22 is closed, the closeout seals 208 may flex and apply pressure against the belt 62 to create a seal between the closeout seal 208 and the belt 62. The closeout seal 208 helps prevent the bulk commodity from passing between the belt 62 and closeout seal 208 and leaking from the hopper. When the trap door 22 is open and the hopper is being discharged, the closeout seals 208 are disposed above the outer rollers 54, and substantially protect the outer rollers 54 from the bulk commodity.

Figure 8:
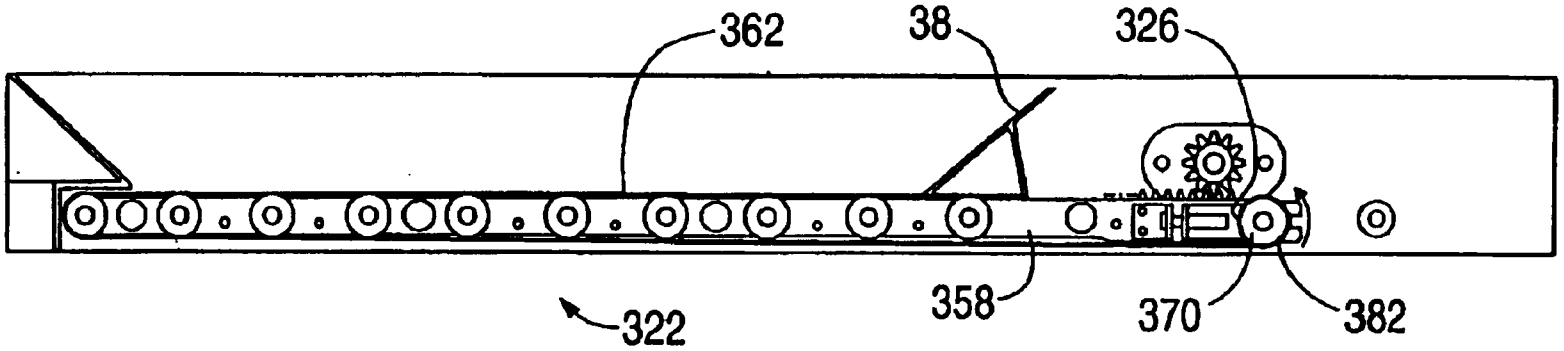
FIG. 8 is a side view of an alternate embodiment.

FIG. 8 illustrates an alternate embodiment of the invention in which the belt 362 winds around an inner roller 370 at the take-up end 382 when the trap door 322 is opened, and unwinds when the trap door 322 is closed. The belt 362 winds and unwinds around the inner roller 370, and the link end 326 is attached to the inner roller 370 instead of being attached to the intermediate member 38. The inner roller 370 at the take-up end 382 of the traversing frame 358 has a torsion spring that biases the inner roller 370 to wind the belt 362.

Figure 9:
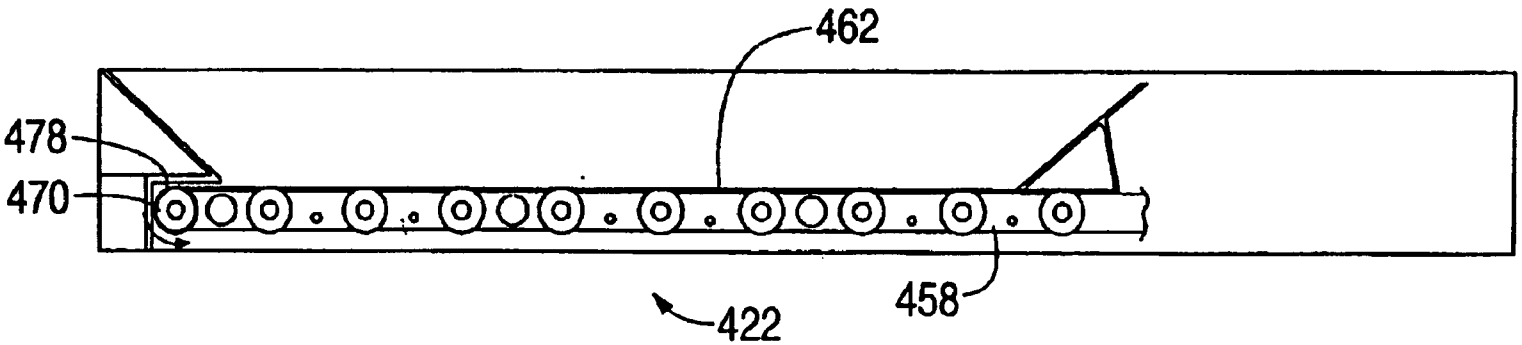
FIG. 9 is a side view of an alternate embodiment.

Another similar alternate embodiment is illustrated in FIG. 9, in which the belt 462 winds and unwinds around the inner roller 470 at the lead end 478 of the traversing frame 458. The inner roller 470 at the lead end 478 has a torsional spring that biases the inner roller 470 to wind the belt 462. The belt 462 winds around the inner roller 470 as the trap door 422 opens, and unwinds from the inner roller 470 as the trap door 422 closes.

What is claimed is:

1. A storage apparatus comprising:

a storage container for containing material, the container having a downwardly-facing discharge opening; and a closure device having an open mode in which the closure device allows the discharge of material through the discharge opening, and a closed mode in which the closure device substantially prevents the discharge of material through the discharge opening, the closure device including a flexible sheet-like member having a closure portion that extends across the discharge opening when the closure device is in the closed mode, and the closure device including a roller that has a longitudinal axis about which the roller is rotatable, and that is movable across the discharge opening in a direction substantially transverse to the longitudinal axis such that, as the closure device changes from the open mode to the closed mode, the roller rolls across the discharge opening in one direction, beneath the closure portion of the flexible member, causing the closure portion to be extended across the discharge opening, and such that, as the closure device changes from the closed mode to the open mode, the roller rolls across the discharge opening in the opposite direction, beneath the closure portion of the flexible member, allowing the closure portion to peel away from material in the container.

2. An apparatus as set forth in claim 1 wherein the roller is rotatably mounted on a frame supported for movement relative to the container.

3. An apparatus as set forth in claim 2 wherein the frame is supported for generally horizontal reciprocal movement relative to the container.

4. An apparatus as set forth in claim 3 wherein the frame supports additional rollers that extend generally parallel to the first-mentioned roller and that are located in substantially the same generally horizontal plane as the first-mentioned roller, such that, as the closure device changes from the open mode to the closed mode, the additional rollers roll across the discharge opening in the one direction, beneath the closure portion of the flexible member, so that the additional rollers support the closure portion across the discharge opening.

5. An apparatus as set forth in claim 4 and further comprising a linear motion device for causing the reciprocal movement of the frame and thereby causing the rollers to roll across the discharge opening.

6. An apparatus as set forth in claim 5 wherein the linear motion device includes a rack and a pinion.

7. An apparatus as set forth in claim 4 wherein the frame includes a pair of generally parallel, generally horizontal tracks that move along wheels mounted on the container.

8. An apparatus as set forth in claim 1 wherein the flexible member is fixed relative to the container on one side of the discharge opening, and wherein the roller moves toward the opposite side when the roller moves in the one direction.

9. An apparatus as set forth in claim 8 wherein the flexible member is an endless belt, wherein the roller is rotatably mounted on a frame supported for generally horizontal reciprocal movement relative to the container, and wherein the frame supports additional rollers that extend generally parallel to the first-mentioned roller and that are located in substantially the same horizontal plane as the first-mentioned roller, such that, as the closure device changes from the open mode to the closed mode, the frame moves in the one direction, and the endless belt travels around the rollers as the rollers roll across the discharge opening in the one direction, so that the rollers support the closure portion across the discharge opening.

10. An apparatus as set forth in claim 9 wherein the endless belt has an upper run and a lower run, wherein the closure portion defines the upper run of the endless belt when the closure device is in the closed mode, and wherein the closure portion defines the lower run of the endless belt when the closure device is in the open mode.

11. A storage apparatus comprising:

a storage container for containing material, the container having a discharge aperture near the bottom of the storage container;

a traversing frame movable with respect to the container between an open condition and a closed condition, and having at least two elongated side supports extending along opposite sides of the traversing frame, and an inner roller that extends between the side supports, and is free to rotate with respect to the side supports; and a flexible member at least partially surrounding the traversing frame and supported at least in part by the inner roller, the flexible member substantially sealing the aperture when the traversing frame is in the closed condition.

12. The storage apparatus of claim 11, wherein the flexible member moves around the traversing frame as the traversing frame moves with respect to the container between the closed condition and the open condition, such that at least a first portion of the flexible member remains substantially stationary with respect to the container while the traversing frame moves, and at least a second portion of the flexible member moves with respect to the container while the traversing frame moves.

13. The storage apparatus of claim 11, further comprising:

a gear shaft interconnected to the container;

a gear rack interconnected to the traversing frame; and a spur gear mounted on the gear shaft intermeshing with the gear rack, such that rotational movement of the gear shaft causes translational movement of the traversing frame.

14. The storage apparatus of claim 11, further comprising a trap frame interconnected to the container and surrounding the aperture, the trap frame having:

a sloped portion sloping downwardly and inwardly toward the aperture;

two elongated side members extending along opposite sides of the trap frame; and a first end and a second end disposed at opposite ends of the trap frame, wherein the traversing frame moves toward the first end and away from the second end as the traversing frame moves from the open condition toward the closed condition.

15. The storage apparatus of claim 14, further comprising multiple outer rollers coupled to the side members facing inwardly toward the aperture and supporting the traversing frame, wherein the outer rollers are bearinged rollers free to rotate with respect to the side members, and the traversing frame rolls over the outer rollers when the traversing frame moves between the closed condition and the open condition.

16. The storage apparatus of claim 15, wherein the outer rollers are spaced and aligned substantially linearly along the side members, and the outer roller near the first end is disposed vertically higher than the outer roller near the second end.

17. The storage apparatus of claim 11, further comprising multiple inner rollers extending between the side supports, each inner roller free to rotate with respect to the side supports, and at least partially supporting the flexible member.

18. The storage apparatus of claim 11, wherein the flexible member is interconnected to the container.

19. The storage apparatus of claim 11, wherein the flexible member is a rubberized canvas material.

20. The storage apparatus of claim 11, wherein the flexible member is an endless loop.

21. The storage apparatus of claim 11, wherein the flexible member includes a contacting segment that substantially seals the aperture when the trap door is in the closed condition, and a link segment having at least one opening to permit debris to fall through the opening and help prevent debris from becoming caught in the flexible member.

22. The storage apparatus of claim 21, wherein the contact segment is disposed substantially above the traversing frame and the link segment is disposed substantially below the traversing frame when the traversing frame is in the closed condition, and the contact segment is disposed substantially below the traversing frame and the link segment is disposed substantially above the traversing frame when the traversing frame is in the open condition.

23. A closure device for closing an aperture near the bottom of a storage container, the closure device comprising:

a trap frame surrounding the aperture;

a traversing frame movable with respect to the trap frame between an open condition and a closed condition and supported by the trap frame;

a flexible member at least partially surrounding the traversing frame and interconnected to the trap frame, and substantially sealing the aperture when the traversing frame is in the closed condition, and the flexible member moves around the traversing frame as the traversing frame moves between the closed condition and the open condition, such that at least a first portion of the flexible member remains stationary with respect to the trap frame while the traversing frame moves, and at least a second portion of the flexible member moves with respect to the trap frame while the traversing frame moves.

24. The closure device of claim 23, wherein the traversing frame is disposed vertically higher in the closed condition than in the open condition.

25. The closure device of claim 23, further comprising:

a gear shaft interconnected to the container;

a gear rack interconnected to the traversing frame; and a spur gear mounted on the gear shaft intermeshing with the gear rack, such that rotational movement of the gear shaft causes translational movement of the traversing frame.

26. The closure device of claim 23, wherein the trap frame comprises two elongated side members, and a first member and an intermediate member that extend between the side members, wherein the side members, first member, and intermediate member have downwardly, inwardly sloping portions and define the aperture.

27. The closure device of claim 26, further comprising multiple outer rollers coupled to the side members facing inwardly toward the aperture and supporting the traversing frame, wherein the outer rollers are bearinged rollers free to rotate with respect to the side members, and the traversing frame rolls over the outer rollers when the traversing frame moves between the closed condition and the open condition.

28. The closure device of claim 23, wherein the traversing frame comprises at least two elongated side supports, and an inner roller extending between the side supports and supporting the flexible member.

29. The closure device of claim 28, wherein the inner roller is an elongated cylindrical member, and is free to rotate with respect to the side supports.

30. The closure device of claim 28, wherein the inner roller includes multiple bearings press-fit on an inner journal and surrounded by an tubular cylindrical outer portion, wherein the outer portion may rotate freely about the inner journal.

31. The closure device of claim 28, further comprising multiple inner rollers extending between the side supports, each inner roller free to rotate with respect to the side supports, and at least partially supporting the flexible member.

32. The closure device of claim 31, wherein the position of at least one of the inner rollers is adjustable with respect to the traversing frame to adjust the tension on the flexible member.

33. The closure device of claim 23, wherein the flexible member is a rubberized canvas material, and has two opposite ends coupled to the trap frame.

34. The closure device of claim 23, wherein the flexible member is an endless loop.

35. The closure device of claim 23, wherein the flexible member includes a contacting segment that substantially seals the aperture when the trap door is in the closed condition, and a link segment having at least one opening to permit debris to fall through the opening and help prevent debris from becoming caught in the flexible member.

36. The closure device of claim 35, wherein the contact segment is disposed substantially above the traversing frame and the link segment is disposed substantially below the traversing frame when the traversing frame is in the closed condition, and the contact segment is disposed substantially below the traversing frame and the link segment is disposed substantially above the traversing frame when the traversing frame is in the open condition.

* * * * *